United States Patent [19]

Diamond et al.

[11] 4,356,649

[45] Nov. 2, 1982

[54] PAGE CONSTRUCTION FOR A STAMP ALBUM

[76] Inventors: Maxwell Diamond; Jack Rose, both of c/o Design Images 71-58 Austin St., Forest Hills, N.Y. 11375

[21] Appl. No.: 216,613

[22] Filed: Dec. 15, 1980

[51] Int. Cl.[3] ..... G09F 1/10

[52] U.S. Cl. ..... 40/159; 40/158 R; 40/405; 40/537

[58] Field of Search ..... 40/159, 537, 405, 159; 281/31, 42

[56] References Cited

U.S. PATENT DOCUMENTS

| | | | |
|---|---|---|---|
| 1,397,096 | 11/1921 | Hammer | 40/16 |
| 2,305,443 | 12/1942 | Pinto | 40/159 G |
| 2,775,050 | 12/1956 | Ellsworth | 40/159 |
| 3,491,471 | 1/1970 | Semple | 40/159 |
| 3,553,439 | 1/1971 | Dorman | 40/159 |
| 3,651,591 | 3/1972 | Woodyard | 40/159 |
| 4,064,645 | 12/1977 | Wood | 40/159 |

FOREIGN PATENT DOCUMENTS

| | | | |
|---|---|---|---|
| 165956 | 5/1950 | Austria | 40/159 |
| 1095256 | 12/1960 | Fed. Rep. of Germany | 40/159 |

*Primary Examiner*—Gene Mancene
*Assistant Examiner*—Wenceslao J. Contreras
*Attorney, Agent, or Firm*—Bauer & Amer

[57] ABSTRACT

A two-ply stamp album page in which cut-outs in the upper-positioned ply form recessed compartments for maintaining the stamps in place therein, and wherein the compartments are completed by plastic strips attached in spanning relation across the cut-outs and functioning as partial closures or covers for the compartments. The recess of the compartments, as well as an inert chemical coating on the compartment surfaces adjacent each stamp rear adhesive surface, obviates any inadvertent adhesive attachment to said stamp surface, said recess preventing the direct application of weight or pressure upon the stamp as might contribute to said inadvertent attachment.

7 Claims, 8 Drawing Figures

PRIOR ART

PAGE CONSTRUCTION FOR A STAMP ALBUM

The present invention relates generally to stamp albums, and more particularly to improvements providing not only an enhanced display of stamps in an album but also obviating such shortcomings as the formation of inadvertent adhesive attachments being established with the stamp rear adhesive surfaces and other such problems.

As understood, stamps are maintained in place in an album by being appropriately mounted or fixed in location upon an album page. The rear adhesive surface of the stamp cannot, of course, be used in the mounting of the stamp and thus so-called corners are typically adhesively secured to the album page and the corners of the displayed stamp inserted therein. Alternatively, the displayed stamp can be placed in a clear plastic envelope which is adhesively secured to the album page. In either case, an attachment is sometimes inadvertently formed with the stamp rear adhesive coat despite reasonable precautions to avoid this occurrence. This is believed due to weight and pressure, sometimes of significant magnitude, directly being applied against the stamp and correspondingly pressing said rear adhesive coat against the supporting surface such that an adhesive attachment unavoidably results.

Broadly, it is an object of the present invention to provide a stamp album page which relieves the stamps displayed thereon of exerted pressure and weight of normal use, and which otherwise overcomes the foregoing and other shortcomings of the prior art. Specifically, it is an object to provide an enhanced display for stamps in an album-type set-up while minimizing the occurrence of any physical damage thereto.

An improved page construction for a stamp album demonstrating objects and advantages of the present invention includes a cardboard substrate delineated by a central fold line into a first ply and second ply. A select number of stamp-sized cut-outs are die-stamped or otherwise formed in the first ply, each cut-out of course having an upper edge. A clear plastic cover is then adhesively secured in spanning relation over and behind each cut-out and at a slight distance below said cut-out upper edge, such that the spaced apart edges cooperate in bounding an access opening for positioning a stamp behind each plastic cover and within the recess of each cut-out. In a preferred embodiment an inert surface coating is applied on the second ply in select areas coextensive with the cut-out locations when the first and second plies are in superposed relation and adhesively secured together. As a consequence, any stamp in place in a cooperating compartment is subjected to an optimum minimum direct application of pressure due to the protection thereagainst afforded by the recess of the compartment.

The above brief description, as well as further objects, features and advantages of the present invention will be more fully appreciated by reference to the following detailed description of presently preferred, but nonetheless illustrative embodiments in accordance with the present invention, when taken in conjunction with the accompanying drawings, wherein.

Figure 3:
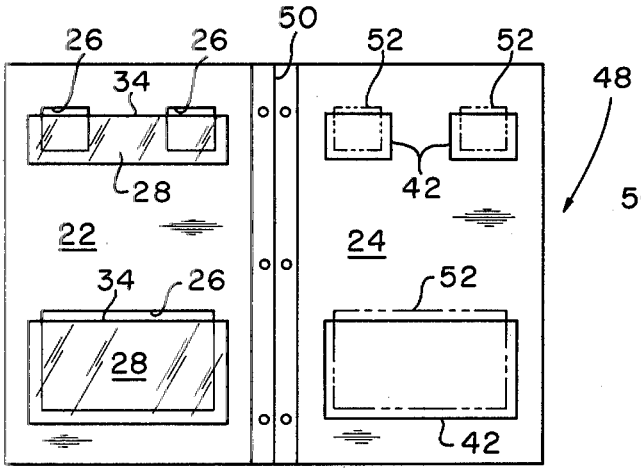
FIG. 3 is a front elevational view of the page construction of FIG. 2, but illustrated at an initial stage of its assembly or construction.
Figure 6:
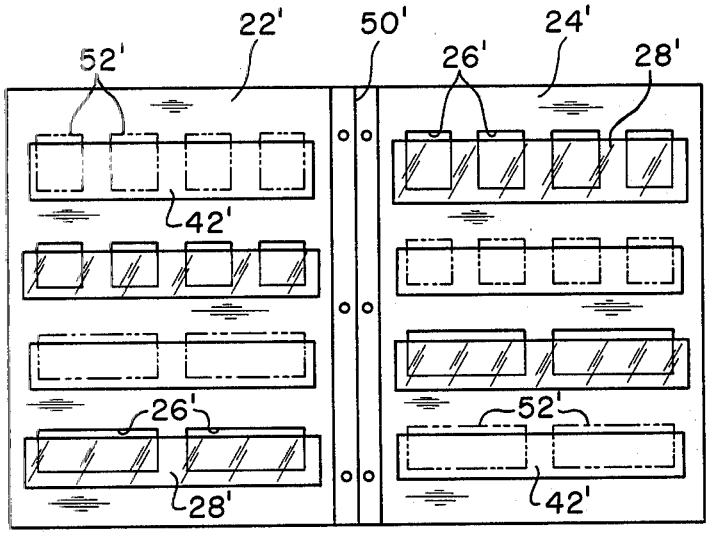
Figure 7:
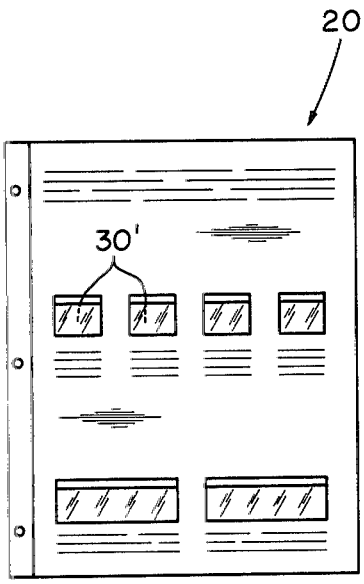
Figure 8:
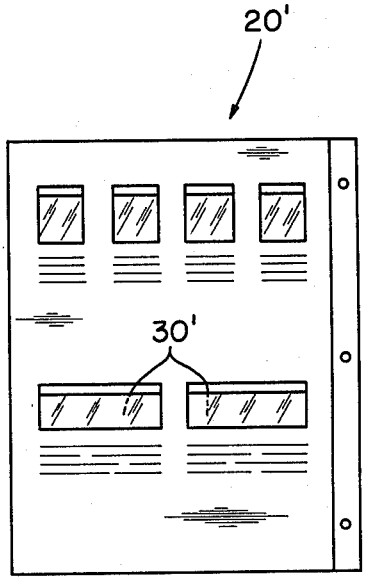

Remaining FIGS. 6–8, inclusive, illustrate another embodiment of an improved stamp album page according to the present invention. More particularly, FIG. 6 is a front elevational view, similar to FIG. 3, illustrating the stamp album page at an initial stage of its assembly or construction; and FIGS. 7 and 8 are front elevational views of the completed stamp album page, FIG. 7 illustrating the page as viewed from the front and FIG. 8 as viewed from the rear.

Figure 1:
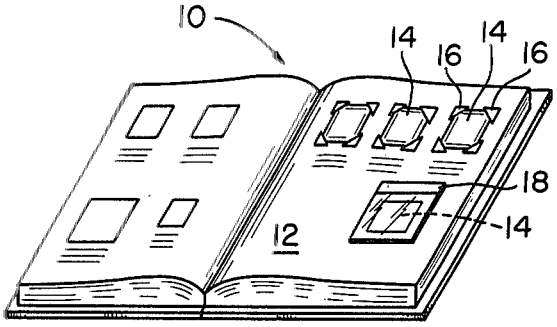
FIG. 1 PRIOR ART
FIG. 1 is a perspective view of a stamp album illustrating conventional and known techniques for maintaining the stamps in place therein.

Shown in FIG. 1 is a stamp album, generally designated 10, on a typical page, designated herein by reference numeral 12, there is illustrated two common techniques for mounting or holding in place the individual stamps of the collection, individually and collectively designated 14. As generally understood, one technique consists of using so-called corners 16 adhesively attached to the page 12 and receiving therein the corners of each cooperating stamp 14. The other technique involves adhesively securing a transparent envelope 18 to page 12 containing a stamp 14 therein. While the referred to and other known techniques are effective in maintaining the stamps 14 in place, they do not obviate the inadvertent adhesive attachment of the stamps 14 to page 12 which could seriously lessen the value of the stamp. One reason for this shortcoming is that the very closing of the album 10, and certainly when other objects are placed on the album, results in considerable weight and pressure being directly applied to the face of the stamp which often contributes to the adhesive rear surface of the stamp becoming attached to the surface of the page on which it is mounted. When using a transparent envelope 18 care of course must be taken to see that the stamp does not attach to the rear panel thereof. In either case, the problem is aggravated by the pressure or weight that is exerted directly on the front surface of the stamp and which as a consequence presses the adhesive surface coating on the rear of the stamp against the page 12 or other substrate.

Figure 2:
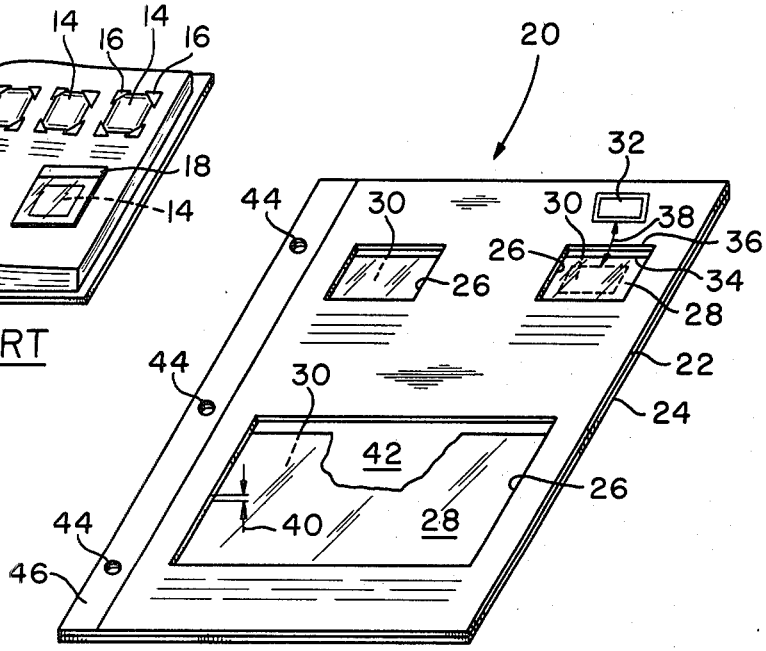
FIG. 2 is a perspective view illustrating an improved stamp album page construction according to the present invention.

The improved page construction according to the present invention, one embodiment of which is generally designated 20 in FIG. 2, not only provides a means by which a collector can effectively display his stamps, but also constitutes a construction which obviates to a significant extent the undesirable contingency of the adhesive surface of the stamp forming an attachment to the surface on which it is being maintained in place. The means by which this and other objectives are achieved will be better understood as the description proceeds.

With reference to the stamp album page 20 of FIG. 2, it will be noted that the same is a two-ply construction comprised of an adhesively attached cooperating first ply 22 and second ply 24 both of which, in a preferred embodiment, are of cardboard construction material.

As the means for maintaining stamps in place, each page 20 will be understood to be comprised in the first or upper ply 22 of plural cut-outs, as exemplified by cut-out 26. Each said cut-out 26, or more particularly the four edges bounding the same, cooperates with a transparent plastic material, designated 28 in FIG. 2, which is mounted in spanning relation across the cut-out 26 so as to bound a compartment 30 for each stamp. See, for example, the stamp specifically designated 32 in FIG. 2. In this respect, the upper edge 34 of each plastic cover 28 and the upper edge 36 of each cut-out 26 are displaced a slight distance from each other so as to provide an access opening into the compartment 30 for the placement and removal of the stamp 32 in relation to such compartment, as illustrated by the double arrow 38.

From the description thus far provided it should therefore be readily understood that when the stamp 32 is inserted in the compartment 30, as indicated by the arrow 38 and as noted by the full line and phantom perspective of stamp 32, the stamp when in place within compartment 30 is not only behind the plastic cover 28 but is also within the confines of a recess which is provided by the edges which bound the cut-out 26. It is primarily due to the recessed nature, as just explained, of the compartment 30 that the stamp 32 will be maintained in place by the construction of page 20 and is considerably and significantly less vulnerable to an inadvertent attachment being formed to its rear adhesive surface than if mounted in place by the conventional techniques previously described in connection with FIG. 1. That is, and as exemplified by the large-sized compartment 30 illustrated in FIG. 2, each said compartment is formed or bounded by an edge having a thickness 40 which, in a preferred embodiment, would be approximately 1/64th of an inch, and would effectively obviate any weight or pressure from making any contact directly against any stamp in a cooperating compartment.

At this point it should also be noted that the area of the top surface of second ply 24 coextensive with each cut-out 26 identified in FIG. 2 by reference numeral 42 consists of a chemically inert surface coating such as a varnish formed of an acetate or polyethylene material. One acceptable material is a polyvinyl acetate coating commercially available from H. B. Fuller of Marlboro, Mass. The chemically inert character of surface coating 42 further obviates the possibility of the formation of any attachment to the stamp rear adhesive surface.

Being intended as a part of a looseleaf-type stamp album, the construction of page 20 is completed by providing binder openings 44 along the inner edge 46 of page 20. The openings 44 of course are not provided in any page construction 20 that in practice will not be maintained in a looseleaf binder.

It is contemplated that different manufacturing procedures can be followed to embody stamp album page 20 with its plural recessed compartments 30. For completeness' sake, one preferred manufacturing procedure will now be described with particular reference to FIGS. 3 and 4. A cardboard substrate or blank 48 is delineated by a central fold line 50 into what is destined o be the upper or first ply 22 on the left and on the right the second or bottom ply 24. Cut-outs 26 are then formed, by die-stamping or otherwise, at select locations in ply 22. Clear plastic strips, preferably acetate, and previously identified as compartment covers 28 are next adhesively secured on ply 22 in spanning relation across the cut-outs 26 in such manner that each upper edge 34 thereof is slightly below the upper edge of each cut-out 26, for the reason as already explained of being able to gain access to the rear of each compartment plastic cover 28.

The next step to be noted is optional. This step is the printing of a decorative color (not designated) over the surface of ply 24 so that the imprinted color is visible through the cut-outs 26 and correspondingly enhances the appearance of the page 20.

Over the imprinted decorative color, if it is used, it is next contemplated that ply 24 will be provided with the previously noted varnished areas 42 which because of their chemically inert character even further minimizes any possibility of an adhesive attachment being formed or established with the rear adhesive surface of any stamp.

Next, it is optional with respect to either ply 22 or ply 24, that an appropriate adhesive, such as an acetate glue, be applied over the ply surface except in those areas where the cut-outs 26 exist in ply 22 or where such cut-outs would be located on the surface of ply 24, such locations being indicated in phantom perspective and designated 52 in FIG. 3.

Figure 4:
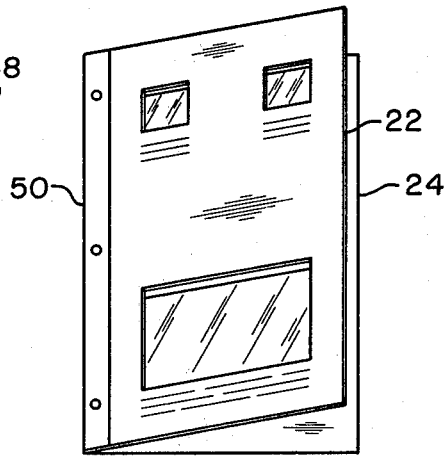
FIG. 4 is a perspective view illustrating the completion of the assembly or construction of said FIG. 2 stamp album page.

FIG. 4 illustrates the folding of the top ply 22 about fold line 50 on top of the bottom ply 24 incident to the adhesive attachment of these two plies together into an integral two-ply construction. While the formation of a page is facilitated using a single blank 48 and the folding of two halves thereof about a central fold line 50, it will of course be understood that instead of a fold along line 50 that the blank 48 can be severed therealong. The use of automated assembly equipment designed for smaller-sized blanks or substrates may require this modification.

Figure 5:
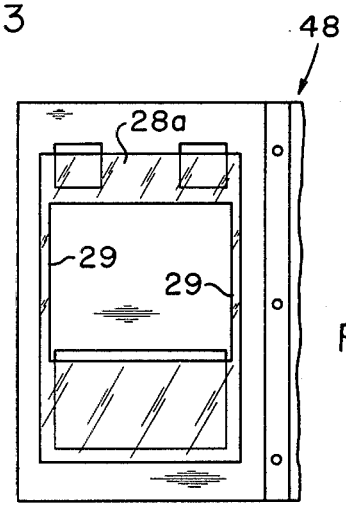
FIG. 5 is a partial front elevational view that is very similar to the left-hand portion of the subject matter of FIG. 3 but illustrating the use of a modified component in the construction of a stamp album page according to the present invention.

Other modifications may also be dictated by the assembly procedures or machinery being utilized. This is intended to be illustrated in FIG. 5 in which the left-hand portion of the blank 48 as described in connection with FIG. 3 is shown with a somewhat modified compartment plastic cover designated 28*a*. It should be readily appreciated from a comparison of FIGS. 3 and 5 that the modification consists of using a single die-cut piece of plastic material over all of the cut-outs and using connecting strips 29 between the upper and lower portions of this component.

In the embodiment shown in FIGS. 6–8, inclusive, to which reference should now be made, it is illustrated how plural recessed compartments 30' having the same structural features already described and therefore designated by the same but primed reference numerals can be provided in a page construction 20' so that access to the compartments 30' and the display of stamps in place therein depends on whether the page is viewed from the front or the rear. In this regard, FIG. 7 illustrates the front of page 20' in which there are recessed compartments 30' as illustrated and in connection with which it will be understood that this is the side of the page from which access is gained into these compartments. FIG. 8, on the other hand, illustrates the rear of page 20' and additional recessed compartments 30' and the different locations occupied by these compartments. As should be readily appreciated, access to the compartments 30' of FIG. 8 is required through the rear of page 20'.

The manner in which page 20' is fabricated should be readily apparent from consideration of FIG. 6 in which structural features already described are designated by the same but primed reference numerals. For completeness' sake it is noted that the upper portion of ply 24' is provided with the cut-outs 26' and with the plastic strip or cover 28'. Cooperating therewith is ply 22' on which is the varnish block 42' and also the adhesive coat for attachment of the two plies together, said coat being applied in all areas except the areas illustrated in phantom perspective and designated 52'.

Still referring to FIG. 6, the situation is just reversed in the bottom portions of the plies 22' and 24'. More particularly, the bottom of ply 22' is provided with the cut-outs 26' and with the adhesively secured plastic cover 28' whereas the bottom of ply 24' has the varnish block 42' and an adhesive coating (not designated) in all areas except areas 52'.

From the foregoing it should be readily appreciated that improved stamp album page constructions 20, 20' can thus be achieved following different fabricating procedures and each will effectively provide plural recessed compartments 30, 30' for maintaining stamps in place therein under circumstances which minimize the exertion of pressure on the stamps while nevertheless providing the collector or philatelist with an enhanced visual display.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An improved page construction for a stamp album comprising a cardboard substrate delineated by a central fold line into a first play and second ply, plural stamp-sized cut-outs in said first ply each having an upper edge, a clear plastic cover adhesively secured in spanning relation across and behind each said cut-out and at a slight distance below said cut-out upper edge to cooperate therewith in bounding an access opening for positioning a stamp behind said plastic cover, an inert surface coating applied on said second ply in select areas coextensive with said cut-out locations when said first and second plies are in superposed relation, and means adhesively securing said first and second plies to each other in a resulting two-ply construction in which each cut-out presents edges bounding a stamp-sized compartment of a recessed depth corresponding to the thickness of said first ply, whereby any stamp in place in a cooperating said compartment is subjected to an optimum minimum direct application of pressure due to the protection thereagainst afforded by said recess of said compartment.

2. An improved page construction for a stamp album as claimed in claim 1 wherein said first ply is folded about said central fold line on top of said second ply to provide said two-ply construction, and an adhesive is applied adjacent all cut-out edges except said upper edge to thereby form each said recess compartment out of each said cut-out in the area behind said area of said plastic cover coextensive with each said cut-out.

3. An improved page construction for a stamp album as claimed in claim 2 wherein said inert surface coating is a selected varnish which obviates the possibility of attachment of a stamp rear adhesive surface to said second ply.

4. An improved page construction for a stamp album as claimed in claim 3 wherein said second ply is printed with a decorative color for display through said cut-outs.

5. An improved page construction for a stamp album comprising identical-sized first and second plies of cardboard construction material, plural stamp-sized cut-outs in said first ply each having an upper edge, a clear plastic cover adhesively secured in spanning relation over and behind each said cut-out and at a slight distance below said cut-out upper edge to cooperate therewith in bounding an access opening for positioning a stamp behind said plastic cover, an inert surface coating applied on said second ply in select areas coextensive with said cut-out locations when said first and second plies are in superposed relation, and means adhesively securing said first and second plies to each other in a resulting two-ply construction in which each cut-out presents edges bounding a stamp-sized compartment of a recessed depth corresponding to the thickness of said first ply, whereby any stamp in place in a cooperating said compartment is subjected to an optimum minimum direct application of pressure due to the protection thereagainst afforded by said recess of said compartment.

6. An improved page construction for a stamp album as claimed in claim 5 wherein said inert surface coating is a selected varnish which obviates the possibility of attachment of a stamp rear adhesive surface to said second ply.

7. An improved page construction for a stamp album as claimed in claim 6 wherein said second ply is printed with a decorative color for display through said cut-outs.

* * * * *